US005875591A

United States Patent [19]

Jines

[11] Patent Number: 5,875,591

[45] Date of Patent: Mar. 2, 1999

[54] PORTABLE PANELS FOR A STAGE SHELL

[75] Inventor: Michael D. Jines, Owatonna, Minn.

[73] Assignee: Wenger Corporation, Owatonna, Minn.

[21] Appl. No.: 797,759

[22] Filed: Feb. 7, 1997

Related U.S. Application Data

[60] Division of Ser. No. 389,262, Feb. 16, 1995, Pat. No. 5,622,011, which is a continuation-in-part of Ser. No. 342,084, Nov. 18, 1994, Pat. No. 5,524,691.

[51] Int. Cl.[6] ..... E04B 7/16

[52] U.S. Cl. ..... 52/66; 52/6; 52/65; 52/69; 52/72; 52/75; 52/78; 52/506.06; 135/908; 160/135; 160/351; 160/229.1; 160/234

[58] Field of Search ..... 52/5, 66, 6, 65, 52/69, 72, 75, 78, 506.06, 67, 68, 70, 71, 74; 135/87, 90, 97, 115, 117, 908; 160/135, 351, 219.1, 234; 16/276

[56] References Cited

U.S. PATENT DOCUMENTS

| | | |
|---|---|---|
| 1,521,803 | 1/1925 | Dossenbach . |
| 2,143,235 | 1/1939 | Bassett . |
| 2,155,876 | 4/1939 | Stout . |
| 2,204,880 | 6/1940 | Bell . |
| 3,002,557 | 10/1961 | Roth et al. . |
| 3,180,446 | 4/1965 | Wenger . |
| 3,181,203 | 5/1965 | Wenger . |
| 3,202,232 | 8/1965 | Rogers . |
| 3,217,366 | 11/1965 | Wenger . |
| 3,417,518 | 12/1968 | Jaffe . |
| 3,435,909 | 4/1969 | Wenger . |
| 3,620,564 | 11/1971 | Wenger . |
| 3,630,309 | 12/1971 | Wenger . |
| 3,768,222 | 10/1973 | Birum . |
| 3,828,884 | 8/1974 | Burdick . |
| 3,866,365 | 2/1975 | Honigman . |
| 3,908,787 | 9/1975 | Wenger et al. . |
| 3,975,850 | 8/1976 | Giaume . |
| 4,214,392 | 7/1980 | Virsen . |
| 4,240,773 | 12/1980 | Terry . |
| 4,241,777 | 12/1980 | Wenger et al. . |
| 4,278,145 | 7/1981 | Eade et al. . |
| 4,426,822 | 1/1984 | Gailey . |
| 4,444,240 | 4/1984 | Bannister . |
| 4,469,354 | 9/1984 | Meetze, Jr. . |
| 4,667,833 | 5/1987 | Jamison . |
| 4,828,005 | 5/1989 | Notley . |
| 4,962,240 | 10/1990 | Judenich . |
| 5,115,608 | 5/1992 | Abraham et al. . |
| 5,263,295 | 11/1993 | Laird et al. . |
| 5,308,218 | 5/1994 | Kobayashi et al. . |
| 5,524,691 | 6/1996 | Jines ..... 160/135 |
| 5,622,011 | 4/1997 | Jines ..... 52/66 |

FOREIGN PATENT DOCUMENTS

| | | |
|---|---|---|
| 782892 | 4/1968 | Canada . |
| 0085905 | 8/1983 | European Pat. Off. . |

*Primary Examiner*—Carl D. Friedman
*Assistant Examiner*—W. Glenn Edwards
*Attorney, Agent, or Firm*—Patterson & Keough, P.A.

[57] ABSTRACT

Adjacent backdrop panels and a suspended canopy comprising a stage shell, wherein the backdrop panels include angular alignment devices for readily and accurately aligning adjacent panels to present a pleasing, uniform appearance and tilt aligning devices to readily align the angle of tilt of the backdrop panels. The suspended canopy formed of individual canopy panels having rotatable hinge devices for storing the canopy panels in a substantially vertical position and having a readily engageable stay assembly for accurately fixing the relative angle of the canopy panels when deployed in a performance position above the backdrop panels.

22 Claims, 11 Drawing Sheets

PORTABLE PANELS FOR A STAGE SHELL

This is a Division of application Ser. No. 08/389,262 filed Feb. 16, 1995, now U.S. Pat. No. 5,622,011, which in turn is a continuation-in-part of application Ser. No. 08/342,084 filed Nov. 18, 1994, now U.S. Pat. No. 5,524,691.

FIELD OF THE INVENTION

This invention relates generally to stage equipment for the performing arts. More specifically, it pertains to stage backdrop panels and canopy panels with improved features including apparatus for angularly aligning adjacent backdrop panels, for accommodating enclosed power cable channels, and for adjusting and maintaining the angle of canopy panels.

BACKGROUND OF THE INVENTION

The practice of staging productions for theater and musical concerts in the same performance facility has necessitated the development of flexible stage layouts. The general purpose approach to the utilization of such facilities has encouraged the use of movable stage backdrop panels. A production team is able to set up any number of stage layouts by simply moving the needed backdrops into position on the stage floor.

Examples of stage panels supported in a generally vertical orientation range from solitary panels supporting scenery to integrated stage backdrop setups enclosing three sides of a stage with multiple panels positioned next to each other to complete the enclosure. Where more than one panel is needed, it is important that adjacent panels be correctly aligned. Each panel edge should be capable of abutting and engaging an adjacent panel edge. This is useful for presenting visually clean lines to the audience, and to ensure proper acoustics.

Additionally, the backdrop panels may have an overhead canopy with integral lighting suspended from the ceiling above the panels. The canopy panels are usually stored in a retracted position proximate the building structure over the stage area, with the canopy panel in a vertical orientation. The canopy panels capable of being raised and lowered to a performing position by means of cables running through pulleys attached to the ceiling over the stage area and rotated into a generally horizontal orientation. The panels that comprise the canopy must be capable of being angularly aligned with respect to one another in a desired relationship. The angular alignment must be repeatable to present a uniform appearance each time that the canopy panels are lowered in to the performing position.

A problem with stage lighting is the routing of power cables to the lighting. Modern stage settings require an incredible maze of power cables to power special effects and sound systems and the like. These cables are difficult to keep organized and, more seriously, present a constant danger to the stage hands. It is desirable to contain as many of the necessary cables as possible within structure in order to minimize confusion and to maximize the safety of the stage hands.

Individual stage backdrop panels may carry vertical panel components extending thirty to forty feet and may weigh as much as two thousand pounds. The vertical stage panels are carried at the front of a support base. Counter weights are carried at the back of the support base to stabilize the panel. Despite the counterweights, the center of gravity of a vertical stage panel remains well up the length of the panel, and the high center of gravity contributes significantly to the difficulty of safely maneuvering vertical stage panels. Maneuvering this much mass and achieving alignment of upwards of forty vertical feet of panelling has proven a daunting task for stage production companies that must also ensure the safety of the personnel moving the panels into place.

One example of a panel support structure useful in this area is disclosed in U.S. Pat. No. 5,115,608 issued to Abraham et al., on May 26, 1992. The '608 patent discloses a plurality of casters in clusters mounted to the base structure in at least three positions. Each caster cluster is also capable of independent height adjustment, facilitating the leveling and alignment tasks. While a useful system, problems are still encountered. The larger and heavier panel structures continue to be difficult to precisely maneuver in increments small enough to be useful to the stage crews. Considerable time is lost in repetitive alignment attempts to achieve the final fit. An additional unanticipated difficulty is encountered in those theaters where the stage floor, for whatever reason, is no longer hard, flat and smooth. Cracks and low spots can develop in stage floors which trap caster wheels. Sudden tilt, and abrupt accelerations and decelerations of the panel structures can result.

An example of a panel transport method and apparatus that combines ease of maneuverability and safety in the transport of portable, vertical stage panels of all weights and heights over uneven as well as hard, flat stage floor surfaces is disclosed in U.S. patent application Ser. No. 08/214,610, filed Mar. 17, 1994 and assigned to the assignee of the present invention. The transport sled disclosed therein transports the backdrop panels partially on a layer of forced air. This relieves the weight on the castors supporting the backdrop panels, permitting ease of motion over uneven stage floor surfaces and prevents the castors from damaging the stage floor surface.

It would be a decided advantage in the industry to have a moveable backdrop panel that is capable of being easily and safely repositioned and is readily alignable with adjacent backdrop panels in all axes, even on uneven stage floors without damaging the stage floors. The backdrop panels should be capable of being aligned in a variety of configurations, such as to present a curved and a straight back portion of the stage setting as desired for different performances. Once aligned, the panels should be capable of being locked in the desired positions of alignment. In addition, it would be advantageous to be able to provide electrical power to overhead lighting by means of enclosed power cables that were not exposed and therefore prone to being inadvertently disengaged. Other features that would be desirable, but have not heretofore been available include a single hinge design that is capable of selectively being configured in rotating or fixed configurations, support structure that includes a power cable channel and a hinge receiver, a canopy panel that rotates to its storage configuration by means of gravity, a releasable, and an adjustable stay for fixing the angle of the canopy panel when the canopy is in the performance configuration.

SUMMARY OF THE INVENTION

The present invention in large part addresses the problems outlined above. The stage panel transport assembly hereof includes a unique panel support base subassembly and a transport sled adapted for lifting engagement with the backdrop panel support base. The panel support base has a first end and a second end with a vertical panel mounted to the first end. The backdrop panel support base is supported on the floor at the first end by at least two feet and at the second end by a plurality of caster mounting members, each member being disposed for rotation through 360 degrees about an axis. The support base feet are adapted to detachably engage a transport sled for transport of the backdrop panel.

The backdrop panels each comprise a fixed center panel that is flanked by a wing panel on either side. The wing panels are hung to permit a varying angular relationship with the center panel and to permit the ready alignment with the wing panel of an adjacent backdrop panel. A system of locking the wing panels in the desired position is provided. Further, the vertical tilt of the backdrop is adjustable through a limited range in order to negate the effects of an uneven stage floor.

The backdrop panels are supported on upright standards that are affixed to a base. The standards have power cable channels defined therein to enclose the power cables that are necessary to provide power to lighting elements that are integrated into the backdrop panels, such as work lighting or decorative wall sconces. The canopy panels are supported on similar standards. In addition to the necessary support, the standards also provide for enclosed power cable channels, so that the cables that run across the top of a canopy are also enclosed.

The panels that comprise the canopy have angular alignment devices that are capable of angularly aligning the adjacent canopy panels with respect to one another in a desired relationship. To facilitate the storage of the canopy panels, the angular alignment devices are capable of being readily disengaged. The canopy panels then rotate to the generally vertical storage configuration by the force of gravity. The angular alignment devices ensure that when the canopy panels are returned to the performing position from storage that the angular alignment is repeatable.

DETAILED DESCRIPTION OF THE INVENTION

Figure 1:
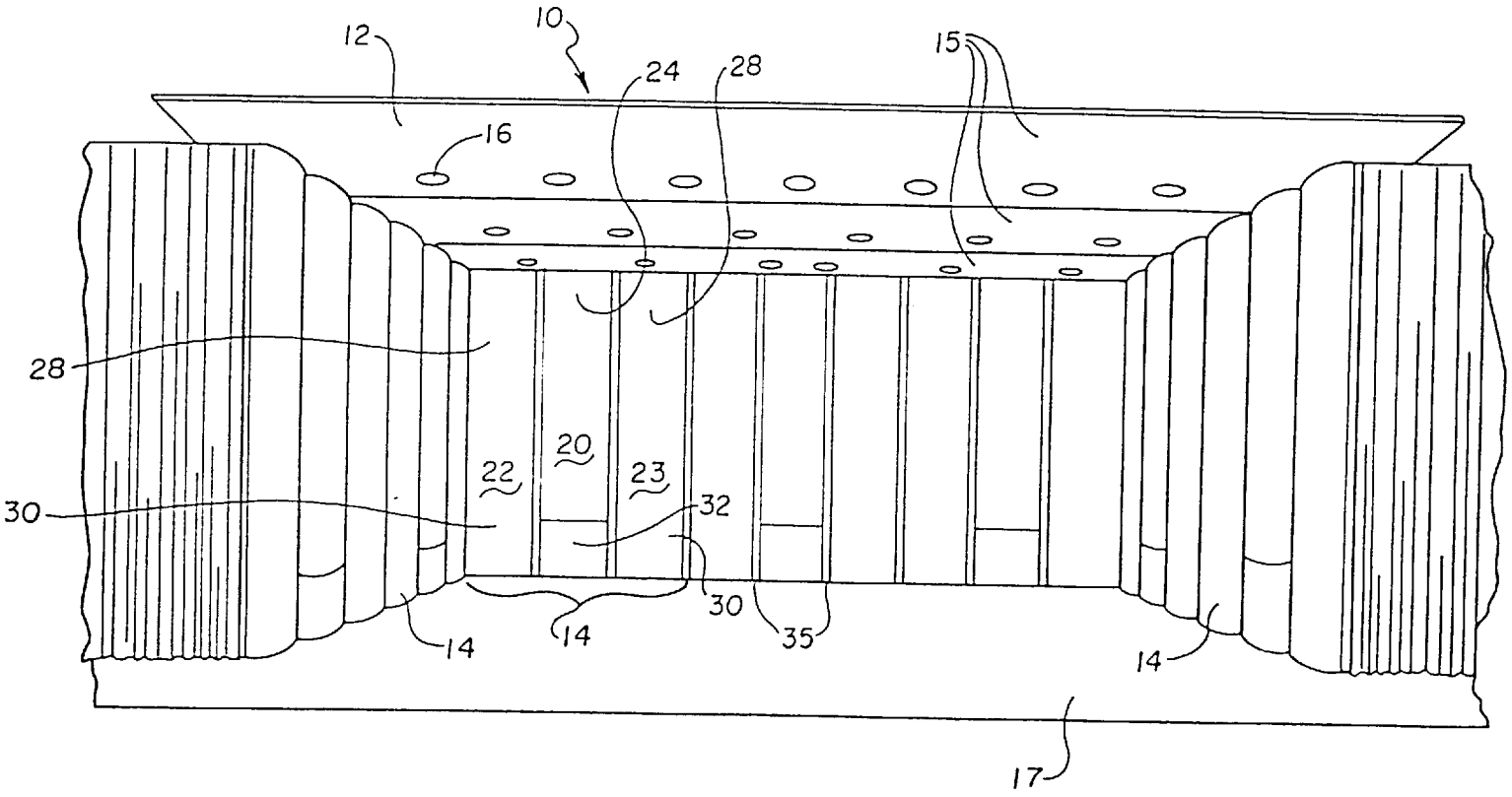
FIG. 1 is a front perspective view of a stage shell comprised of backdrop panels and canopy panels in accordance with the present invention in suitable alignment.

Referring to the figures, the stage shell of the present invention is shown generally at 10 in FIG. 1. Stage shell 10 is comprised of a canopy 12 and backdrop panels 14.

The canopy 12 is formed of three adjacent canopy sections 15. It is understood that more or fewer canopy sections 15 may be utilized as desired to comprise canopy 12. The canopy sections 15 are preferably suspended from the building structure above the stage area on cables. The canopy sections 15 that comprise the canopy 12 are not joined together. In order to present a uniform appearance the canopy sections 15 must all be oriented at the same angle. It is desirable that the angle be easily repeatable each time the canopy sections 15 are lower Each of the canopy sections 15 has a series of integral lights 16 mounted therein.

The backdrop panels 14 are positioned on stage floor 17 as desired for the particular performance to be given. Each of the backdrop panels 14 is a fixed center panel section 20 that is flanked by wing panel sections 22. Further, the center panel section 20 is comprised of an upper center panel 24, a lower center panel 26, and a removable filler panel 32. Each of the wing panel sections 22 is comprised of an upper wing panel 28 and a lower wing panel 30. When a plurality of backdrop panels 14 are positioned adjacent to one another to form stage shell 10, a decorative strip 35 is mounted between adjacent center panel sections 20 and wing panel sections 22 in order to create an appealing appearance for the audience. The decorative strip 35 is typically an extruded strip of aluminum suitably finished to provide an appealing appearance.

Figure 2:
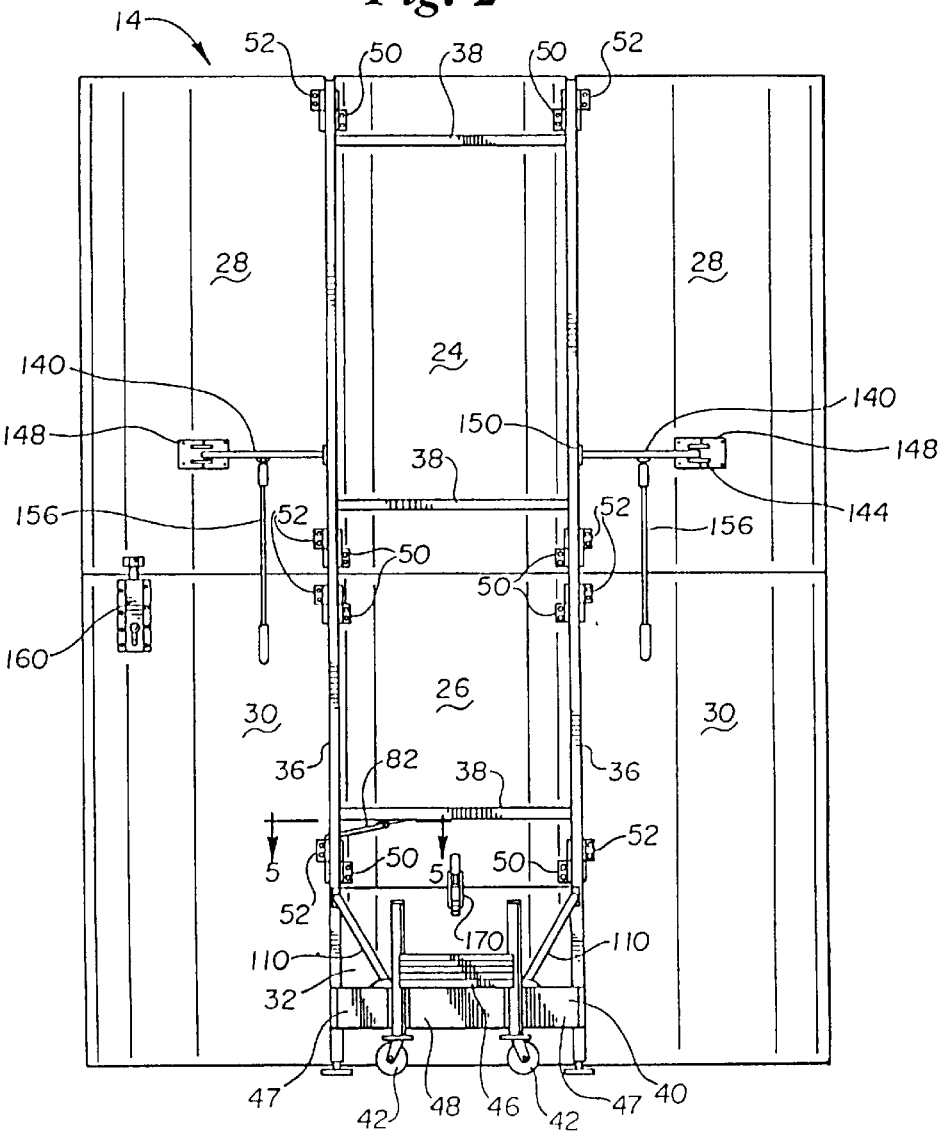
FIG. 2 is a rear elevational view of an erect backdrop panel.

Referring to FIG. 2, the center panel section 20 and wing panel sections 22 of backdrop panels 14 are supported by upright standards 36 and are preferably formed of extruded aluminum. Cross members 38 span between two upright standards 36 to provide increased structural integrity. Cross members 38 are also preferably formed of extruded aluminum.

The upright standards 36 are affixed to base 40. Base 40 is mounted on the rear to casters 42 and at the front to adjustable feet 44. Counterweights 46 are included at the rear to balance the weight of the center panel section and wing panel sections 22. Base 40 defines a generally trapezoidal shape having side members 47 connected to upright standards 36 and tapering inward to connect to the relatively narrow end member 48.

Figure 8:
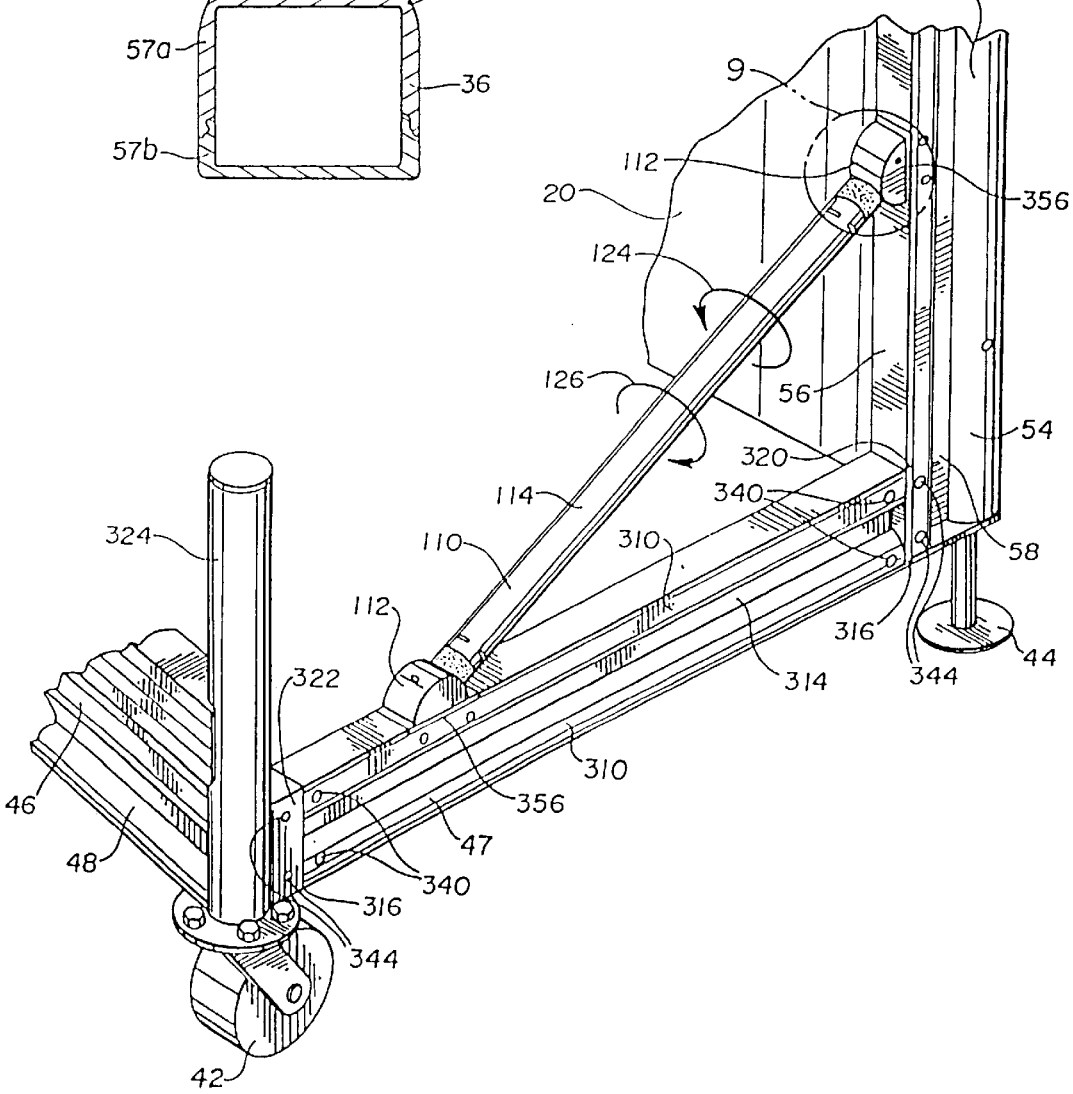
FIG. 8 is a perspective view of the tilt adjustment arm connected to the base and upright standard of the backdrop panel.
Figure 9:
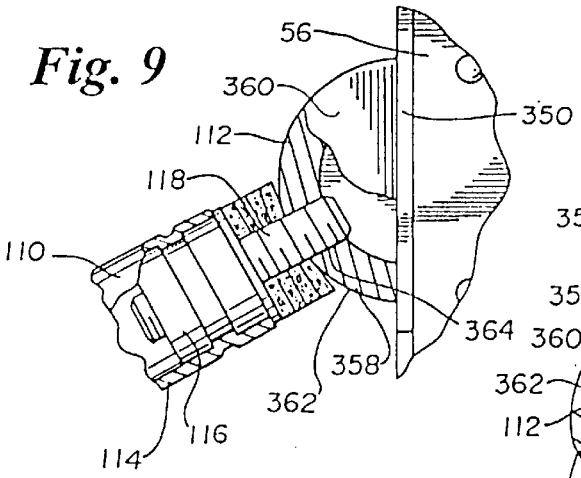
FIG. 9 is a sectional view of the joint of the tilt adjustment arm with the taken upright standard along the sectional circle nine of FIG. 8.

As depicted in FIGS. 8 and 9, the side members 47 and the end member 48 are preferably formed from a selected length of extruded aluminum that is comprised of a similar cross section. In cross section, the side members 47 and the end member 48 have a first generally hexagonal portion 310, a second generally hexagonal portion 312, and a joining gusset 314. The first generally hexagonal portion 310 and the second generally hexagonal portion 312 each define a cavity therein that extends the full length of the member 47, 48. This type of structure provides relatively great strength while at the same time minimizing the weight if the base 40. It is understood that other geometric shapes such as a cylindrical, rectangular, or triangular shape, could be used in place of the first generally hexagonal portion 310 the second generally hexagonal portion 312. The universal joint casting 316 is depicted in FIG. 10*a*.

By utilizing members 47, 48 having similar cross sectional shapes, a common casting may be utilized as a connector to join the members 47, 48 to other structural components as desired. The universal joint casting 316 is preferably formed of an aluminum casting. Joint casting 316 has a generally box section 318 that is designed to be joined with other structural components as desired. The box section 318 is designed to be inserted within a suitable receiving aperture defined in the structure to which the member 47, 48 is to be joined. For example such an aperture 320 is defined in upright standard 36, as depicted in FIG. 8. Similarly, an aperture (not shown) is formed in fitting 322 that is affixed to upright frame 324.

Figure 10A:
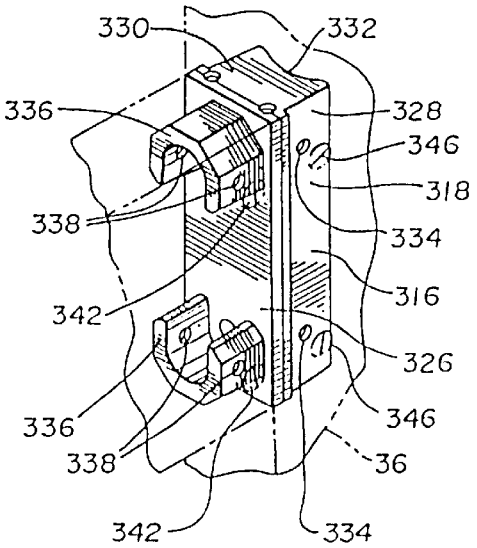
FIG. 10*a* is a perspective view of the casting that comprises the joint utilized with the side members and the end member.

The box section 318 joint casting is best viewed in FIG. 10*a* and has a floor 326 with opposed sides 328 and joining ends 330. The ends 330 have a relatively shallow semicircular groove 332 formed therein. Threaded bores 334 are formed in the sides 328.

Two hexagonal connectors 336 are formed on the reverse side of floor 326 of box section 318. The hexagonal connectors 336 are preferably formed of five sides of a hexagon with the sixth side open and facing the other hexagonal connector 336. The hexagonal connectors have a slightly narrowing taper as the distance along the hexagonal connector 336 increases away from the reverse side of floor 326 of box section 318. The exterior dimensions of the hexagonal connectors 336 are slightly less than the interior dimensions of the cavity formed within the first generally hexagonal portion 310 and the second generally hexagonal portion 312 of the members 47, 48. Accordingly, the connectors 336 are readily received within the first generally hexagonal portion 310 and the second generally hexagonal portion 312 of the members 47, 48. It is understood that other geometric shapes can be substituted for the hexagonal connectors 336 to conform to the alternative geometric shapes that are substituted for the first generally hexagonal portion 310 the second generally hexagonal portion 312, as described above.

Threaded bores 338 are formed in the connectors 336. The threaded bores 338 are positioned such that bores 340 formed in first generally hexagonal portion 310 and the second generally hexagonal portion 312 of the members 47, 48 are in registry therewith when the connectors 336 are inserted into the first generally hexagonal portion 310 and the second generally hexagonal portion 312 of the members 47, 48. Suitable screws 342 are threaded through the bores 340 and into the threaded bores 338 to affix the joint casting 316 to the members 47, 48.

In order to effect connection of the joint casting 316 to the other structural members bores 344 are formed in such structures. The bores 344 in the upright standard 36 and the fitting 322 are depicted in FIG. 8. The bores 344 are brought into registry with the bores 334 formed in joint casting 316 as the joint casting 316 is inserted in the apertures 318 formed therein. Suitable threaded screws 346, depicted in FIG. 10*a*, are passed through the bores 344 and threaded into the bores 334. In this manner, the construction of the base 40 is made substantially modular. The members 47, 48 are made from a single extrusion and then cut to length. The joint casting 316 is utilized at both ends of each of the members 47, 48 to effect the joining of the members 47, 48 to the support structure, as for example to the upright standard 36 and to the fitting 322 that is affixed to upright frame 324.

Four pairs of hinges are coupled to each of the upright standards 36. Each hinge pair is comprised of a fixed hinge 50 and a rotatable hinge 52. The fixed hinge 50 and the rotatable hinge 52 are formed identically and are adapted to be selectively utilized in either a rotatable or a fixed configuration. The fixed hinges 50 fixedly couple both the upper center panel 24 and lower center panel 26 to the upright standards 36. The rotatable hinges 52 couple the upper wing panels 28 and lower wing panels 30 to the upright standards 36.

Figure 4:
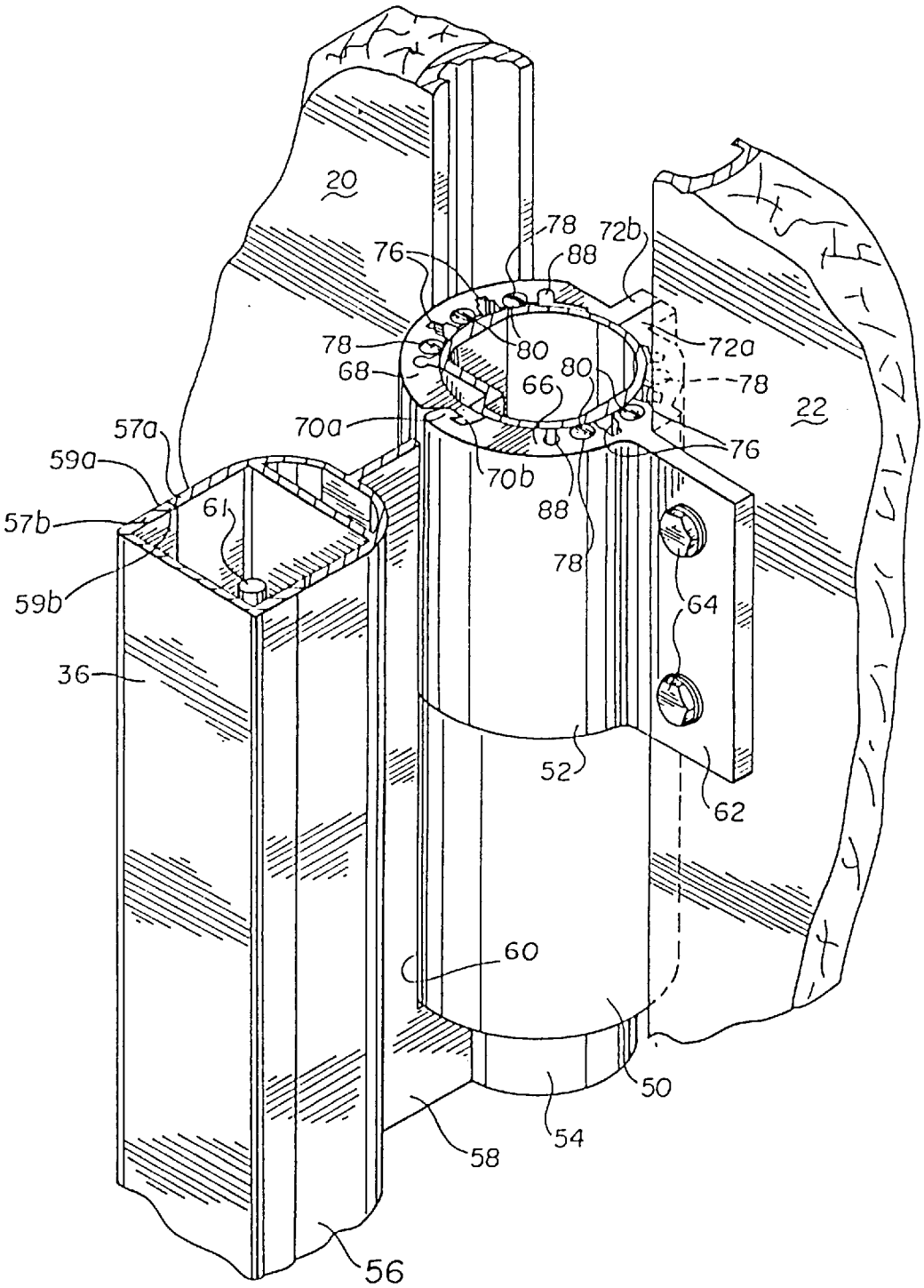
FIG. 4 is a fragmentary perspective view of a backdrop panel depicting a portion of the upright standard and a hinge system for a center panel and a wing panel of the backdrop panels.

The coupling between the fixed hinge 50, rotatable hinge 52 and the upright standards 36 is depicted in FIG. 4. The upright standards 36 have three major subcomponents: the generally circular section 54, the generally rectangular section 56, and the joining web 58. The rectangular section 56 is preferably formed in two slideably engageable rectangular section portions 57*a*, 57*b*. The rectangular section portions 57*a*, 57*b* include cooperating rib and groove structures along their leading margins 59*a*, 59*b* that are slideably joined to formed rectangular section 56. The web 58 is continuous between circular section 54 and rectangular section 56, except approximate the hinges 50, 52. In the area approximate hinges 50, 52, a cutout 60 is defined in joining web 58 in order to accommodate hinges 50, 52. The cutout 60 is spaced slightly apart from the hinges 50, 52 in order to permit the rotation of rotatable hinge 52 therein. The generally circular section 54 comprises a hinge receiver for mounting the hinges 50, 52 thereon. An electrical power cable 61 is depicted carried within the rectangular section 56.

Each of the hinges 50, 52 has a panel flange 62 adapted to join a center panel section 20 or wing panel section 22 to the hinge 50, 52. The panel sections 20, 22 are affixed to the panel flanges 62 by bolts 64.

Each hinge 50, 52 is formed with a first half 66 and a second half 68. The two halves 66, 68 are joined at a first side by interlocking fingers 70*a*, 70*b*. The two halves 66, 68 are joined at a second side by mating flanges 72*a*, 72*b*. The mating flanges 72*a*, 72*b* are affixed by suitable bolts 74 passing therethrough. It should be noted that the hinges 50, 52 define an inner diameter that is slightly greater than the outside diameter of the circular section 54 of upright standard 36. Accordingly, the hinges 50, 52 are free to rotate about circular section 54.

The hinges 50, 52 are identical components. Each hinge 50, 52 has a series of key ways 76 and bearing ways 78 defined approximate the inner diameter of the hinge 50, 52. Each key way 76 and bearing way 78 is a particularly shaped groove that extends the full height of the hinge 50, 52 and intersects the inner diameter thereof. Key ways are formed from a generally larger and smaller intersecting rectangular groove. The larger of such grooves intersects the inner diameter of the hinge 50, 52. The bearing ways 78 define a generally circular groove intersecting the inner diameter of the hinges 50, 52.

Rotatable hinge 52 is designed to be freely rotatable about circular section 54 of upright standard 36. To effect this rotation, circular bearings 80 are pressed into each of the bearing ways 78. Each bearing is a rod preferably made of a plastic material and has a length that is generally equal to the height of the hinge 52. The bearing is circular in cross section. When pressed in bearing way 78, bearing 80 projects slightly beyond the inner diameter of hinge 52 and engages the outer diameter of circular section 54. As hinge 52 is rotated about circular section 54, bearing 80 slides along the exterior surface of circular section 54 thereby providing a rotatable bearing surface with the upright standard 36.

Figure 5:
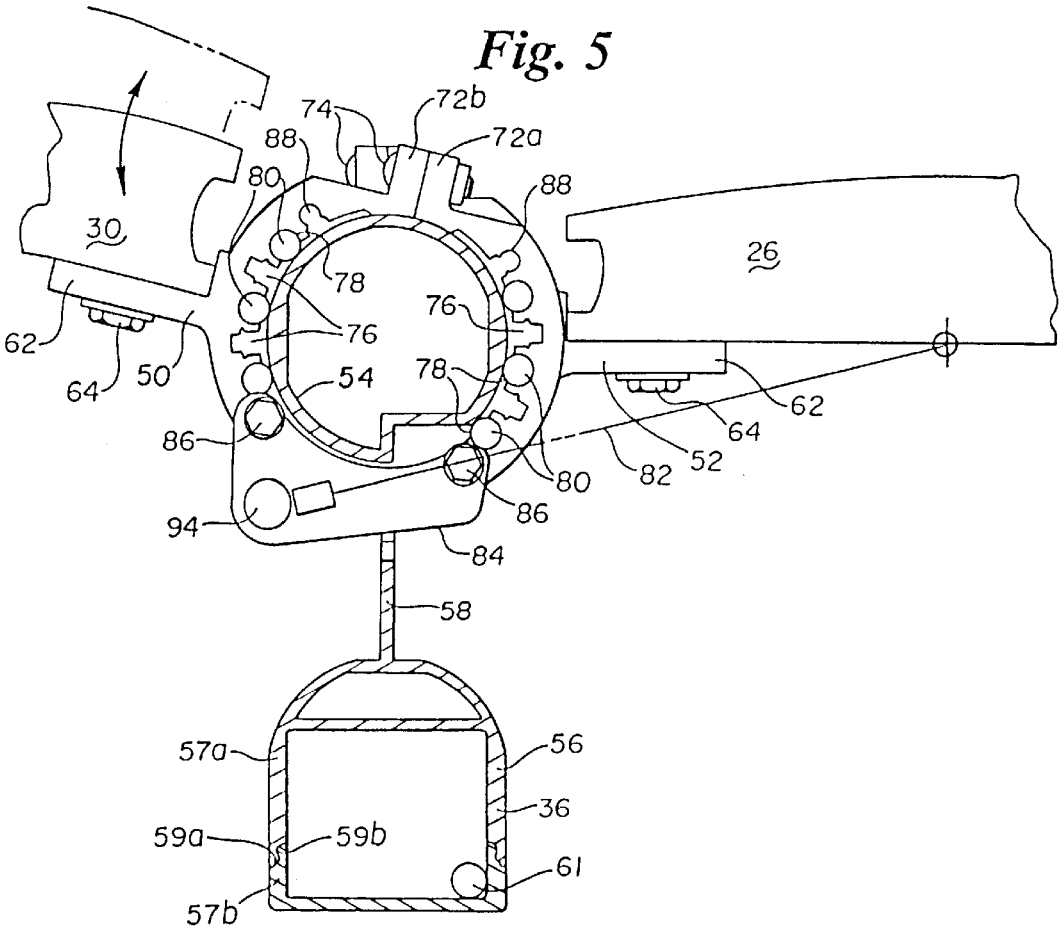
FIG. 5 is a top sectional view of the hinge system for the center panel and a wing panel of backdrop panel taken along line 5—5 of FIG. 2.

Referring to FIG. 5, it can be seen that the wing panel section 22 is rotatable through an arc of approximately 80 degrees as indicated by arrow 82 with respect to center panel section 20. In the depiction of FIG. 5, it can be seen that the bearings 80 bear upon the exterior diameter of circular section 54 of upright standard 36. It should be noted that the key ways of 76 are not utilized when the hinge 52 is intended to be rotatable with respect to circular section 54.

Figure 6:
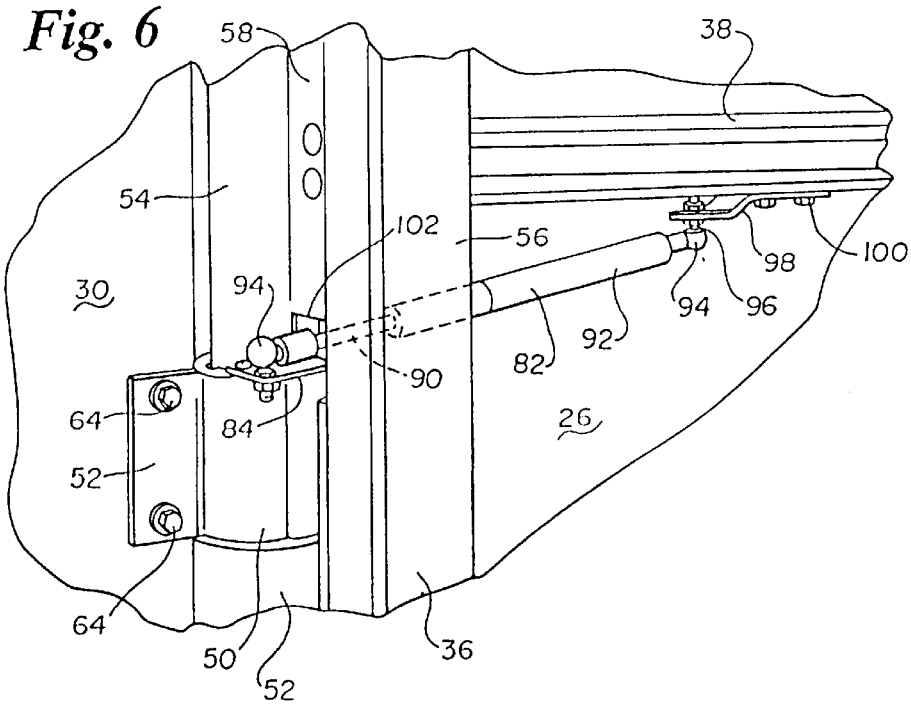
FIG. 6 is a fragmentary perspective view of a backdrop panel depicting the pneumatic positioner attached to the rotatable hinge of a wing panel.

Referring to FIGS. 5 and 6, a pneumatic positioner 82 is provided to assist in positioning lower wing panel 30 angularly with respect to lower center panel 26. Pneumatic positioner 82 has a first end anchored on cross member 38 and a second end anchored on bracket 84. Bracket 84 is affixed to and rotates with rotatable hinge 52. Bracket 84 is affixed to rotatable hinge 52 by bolts 86 fitted into bores (not shown) corresponding to bores 88.

Pneumatic positioner 82 is comprised of rod 90 slideably positioned within pneumatic tube 92. Both ends of pneumatic positioner 82 have a socket joint 94 rotatably enclosing a ball 96. The ball 96 is affixed conventionally by a bolt and nut to bracket 84 at one end and to bracket 98 at the second end. Bracket 98 is affixed to cross member 38 by bolts 100. An aperture 102 is formed in adjoining web 58 of upright standard 36. Pneumatic positioner 82 is passed through aperture 102.

Figure 7:
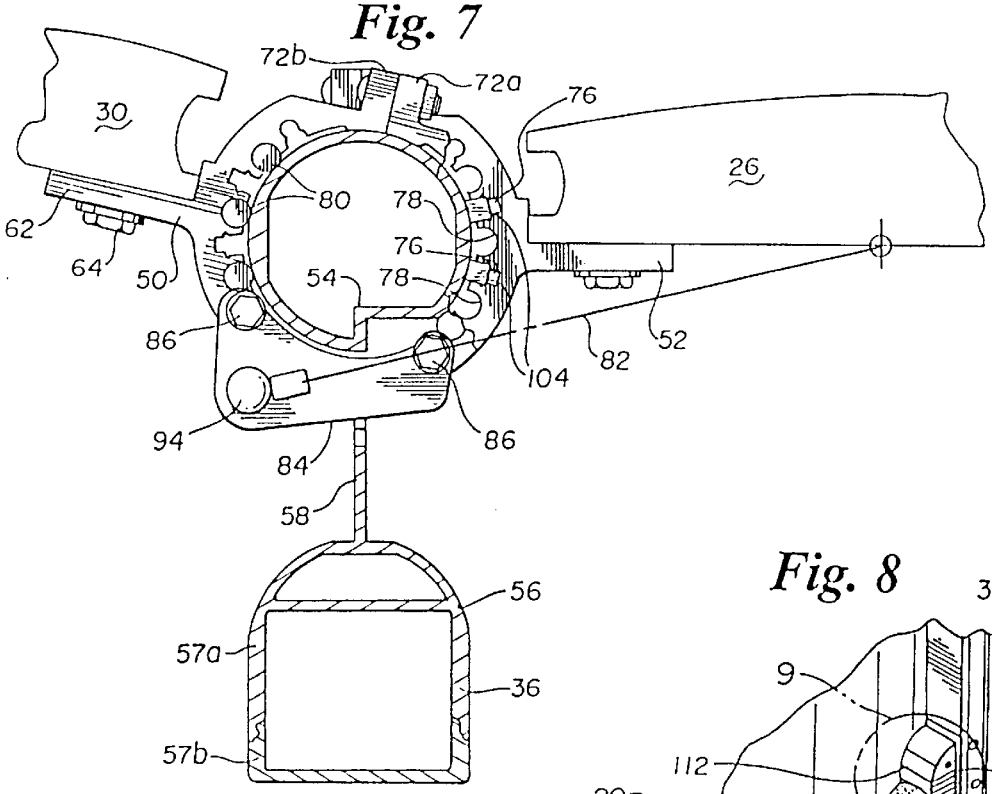
FIG. 7 is a top plan view of the hinge system with a portion of the rotatable wing hinge broken out to view the fixed hinge of a center panel.

Referring to FIG. 7, a portion of rotatable hinge 52 is broken away to reveal the fixed hinge 50 beneath rotatable hinge 52. It should be noted that no bearings 80 are included within the bearing ways 78 formed within fixed joint 50 in order to affix fixed joint 50 to the circular section 54 of upright standard 36, keys 104 are driven into key ways 76. Keys 104 are typically elongated rods having a rectangular cross sectional area. The length of the rod is preferably equal to the height of fixed hinge 50. The keys 104 are preferably made of a steel material. Keys 104 are sized such that when driven into key ways 76, a side of keys 104 tightly engages the exterior circumference of circular section 54, thereby preventing rotation of fixed hinge 50 about circular section 54.

Two tilt adjustment arms 110 are depicted in FIG. 2. Detail of the tilt adjustment arms 110 is depicted in FIGS. 8–10*a*. Tilt adjustment arm 110 is connected at both ends by joints 112. The joints 112 are preferably formed of aluminum castings that define a shell about an open space. At one end the joint 112 is affixed to side member 47 of base 40. At the other end, joint 112 is affixed to upright standard 36.

Figure 9A:
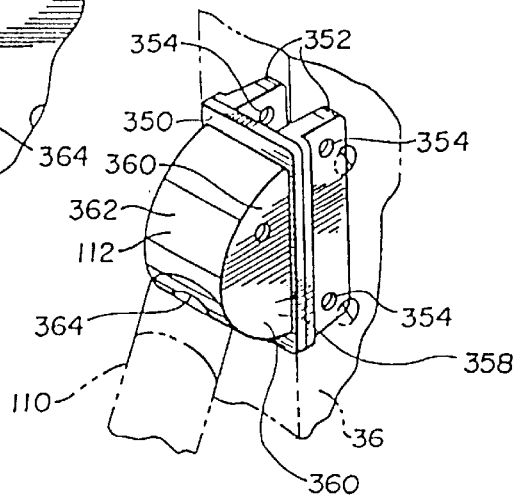
FIG. 9*a* is a perspective view of the casting that comprises the joint of the tilt adjustment arm.

Detail of the construction of the joint 112 is depicted in FIGS. 9 and 9*a*. The joint 112 has a substantially rectangular base 350. Two opposed flanges 352 are formed on a first side of the base 350. The flanges 352 are preferably rectangular in shape. Each flange 352 has a pair of threaded bores 354 defined therein. The flanges are designed to be received within a generally rectangular aperture 356 defined in upright standard 36 and side member 47, as appropriate.

A substantially semi-circular mount 358 is formed on the opposite side of the base 350 from the flanges 352. Mount 358 has two spaced apart semi-circular walls 360 joined at the outer margins thereof by an arced wall 362. A suitable threaded bore 364 is formed therein at a selected position along the arced wall 362 to orient the tilt adjustment arm 110 at the desired relationship thereto.

A rotatable arm 114 expands the distance between the two joints 112. The rotatable arm 114 is preferably a hollow metal tube having a plug 116 pressed into both ends. The plug 116 has a shredded bore (not shown) that is formed axially within the plug 116. A stud 118 is threaded into the bore formed in the plug 116. The studs 118 in the two joints 112 have opposite directed threads cut therein, such that rotation of rotatable arm 114 in a direction acts either to withdraw both studs 118 from the plugs 116, thereby lengthening tilt adjustment arm 110, or to turn both the studs 118 further into the plugs 116, thereby shortening tilt adjustment arm 110.

Figure 10:
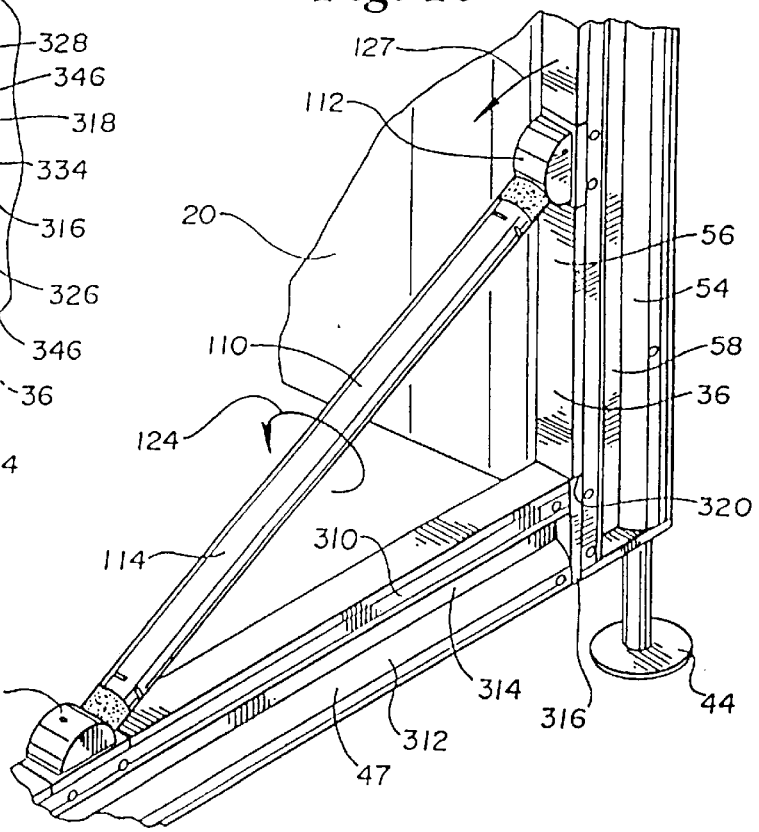
FIG. 10 is a perspective view of a tilt adjustment arm depicting the effect of shortening the length of the tilt adjustment arm to adjust the tilt of the backdrop panel.

The studs 118 are tightly threaded into joint 112. Rotatable arm 114 may be rotated in a counterclockwise direction as indicated by arrow 124 or any clockwise direction as indicated by arrow 126. As indicated in FIG. 10, rotation in the counterclockwise direction decreases the distance between the two points 112, thereby causing the upright standard 36 to tilt as indicated by arrow 127.

Figure 3:
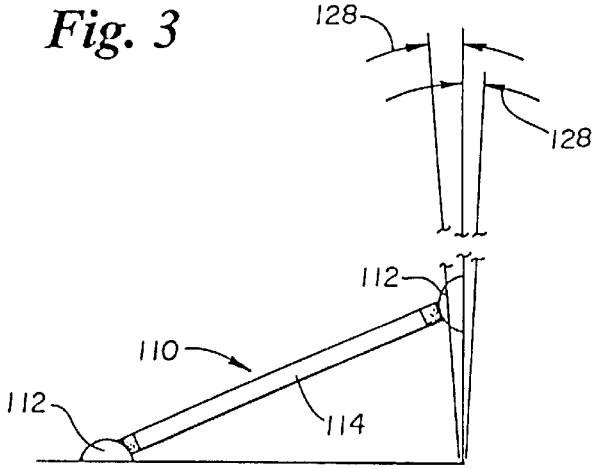
FIG. 3 is a side elevational view of the tilt adjustment arm depicting the tilt adjustment of the backdrop panel that is available through the rotational lengthening and shortening of the tilt adjustment arm.

The range of tilt motion is indicated by arrows 128 in FIG. 3. The angles subtended need not be very great in order to provide an adequate amount of control to accomplish alignment of adjacent backdrop paddles. It should be understood that the upright standards 36 are not hinged at base 40. Adjusting the tilt is accomplished by slightly bending the upright standards 36.

Figure 11:
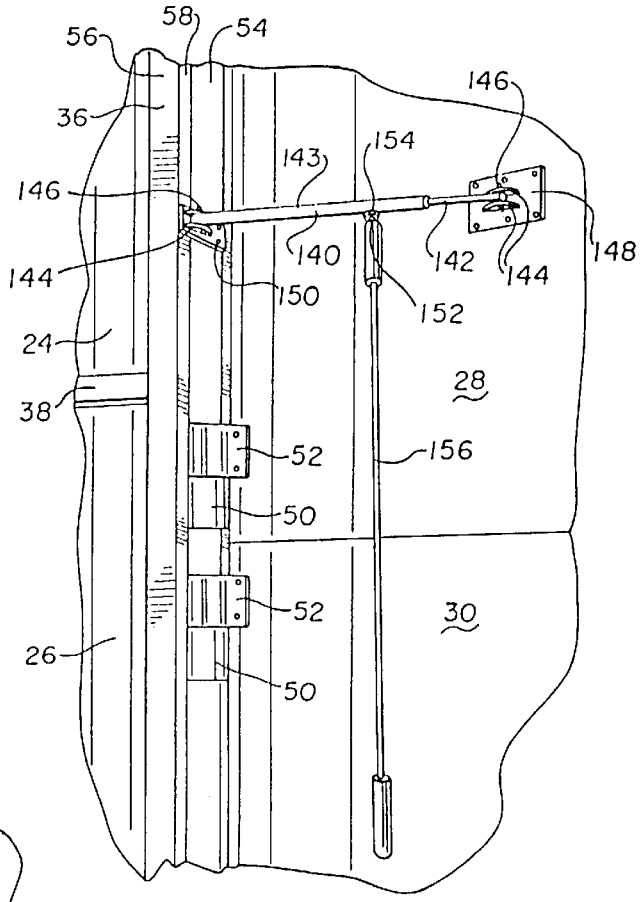
FIG. 11 is a rear elevational view of the lock bolt pneumatic positioner for the upper wing panel of the backdrop panel.

FIGS. 2 and 11 depict locking positioner 140. Locking positioner 140 acts in conjunction with pneumatic positioner 82 to position the wing panel sections 22 as desired. Locking positioner 140 has a rod 142 slideably disposed within tube 143. The end of rod 142 is affixed to semi-circular brackets 144 by a bolt 146 passing through bores that are in registry in formed brackets 144 and rod 142. The end of tube 143 is affixed to semi-circular brackets 144 by a bolt 146 similarly disposed in bores brought into registry that are formed in semi-circular brackets 144 and the end of tube 143. Mounting plate 148 is affixed to upper wing panel 28. Mounting plate 150 is affixed to upright standard 36. A set screw 152 is threaded into nut 154 and passes through a bore formed in tube 143 to engage rod 142. When the desired angular relationship between upper wing panel 28 and upper center panel 24 has been achieved, an operator rotates handle 156 to engage set screw with rod 142, fixing upper wing panel 28 in the desired position.

Figure 12:
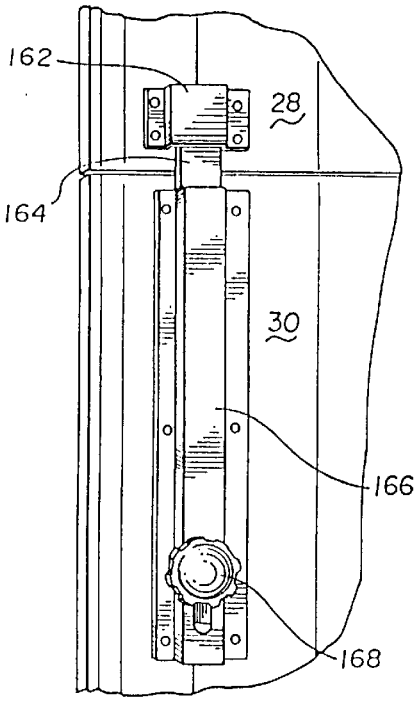
FIG. 12 is a elevational view of the lock bolt that engages a lower wing panel to an upper wing panel.

Referring to FIGS. 2 and 12, a lower wing panel lock 160 is depicted. Wing panel lock 160 is comprised of a catch 162 affixed to upper wing panel 28. A bolt 164 slideably engages catch 162. The bolt 164 rides within slide receiver 166. Slide receiver 166 is affixed to lower wing panel 30. A threaded lock nut 168 is threaded into a bore formed in bolt 164. Bolt 164 is slideably engaged with catch 162, threaded lock nut 168 can be turned down to lock bolt 164 in place.

Figure 13:
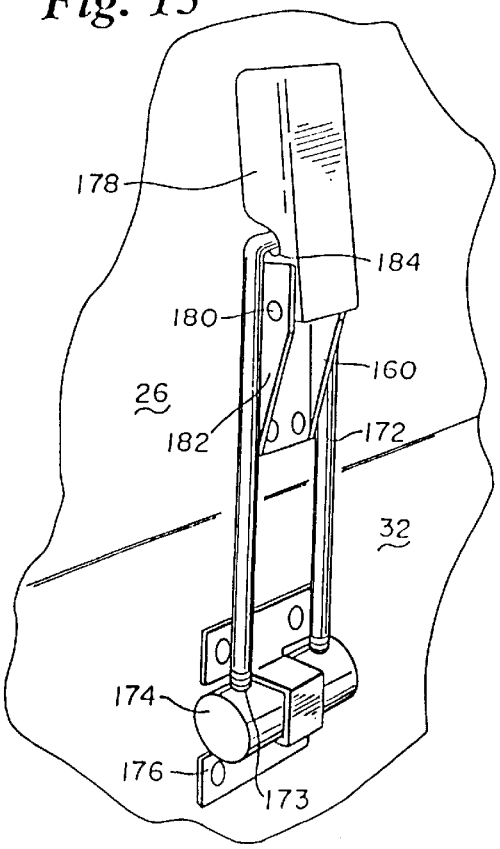
FIG. 13 is a perspective view of the over center locking device that holds the kick panel in place beneath the center panel.

Referring to FIGS. 2 and 13, a filler panel lock 170 is depicted. Filler panel lock 170 includes a U bolt 172. The ends of U bolt 172 pass through bores 173 formed in cross bolt 174. Suitable nuts are threaded onto the ends of U bolt 172. Cross bolt 174 is held within bracket 176. Bracket 176 is affixed to filler panel 32.

Over center latch 178 is rotatably affixed to bracket 182 by hinge 180. U bolt retaining groove 184 is formed over center latch 178. When filler panel lock 170 is placed in the latched position as indicated in FIG. 13, an upward and rearward force is exerted on filler panel 32 holding it firmly against the lower margin of lower center panel 26 and the front face of the two bright standards 36.

Figure 14:
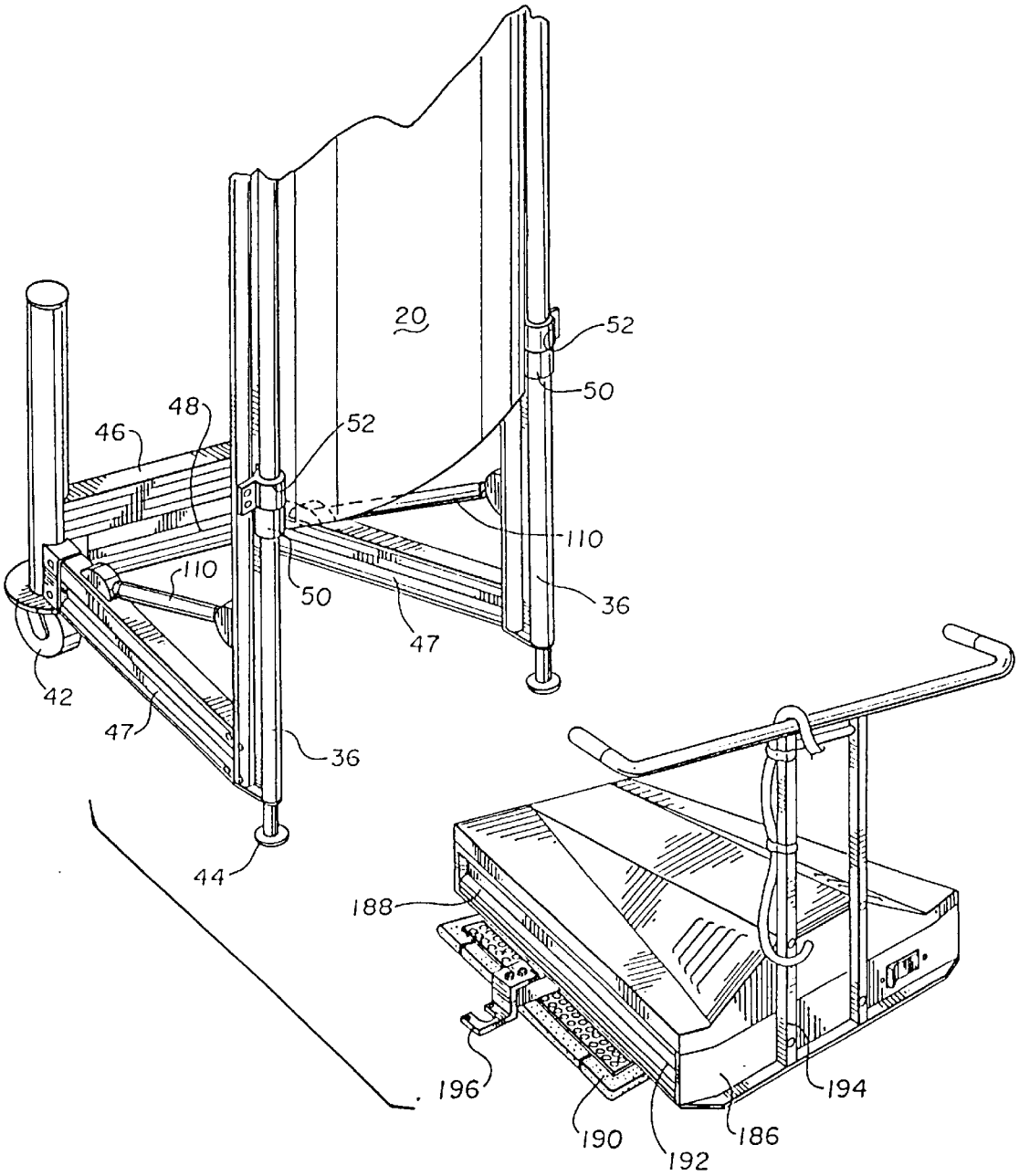
FIG. 14 is a perspective view of the panel transporter prior to engagement with the base of a backdrop panel.
Figure 15:
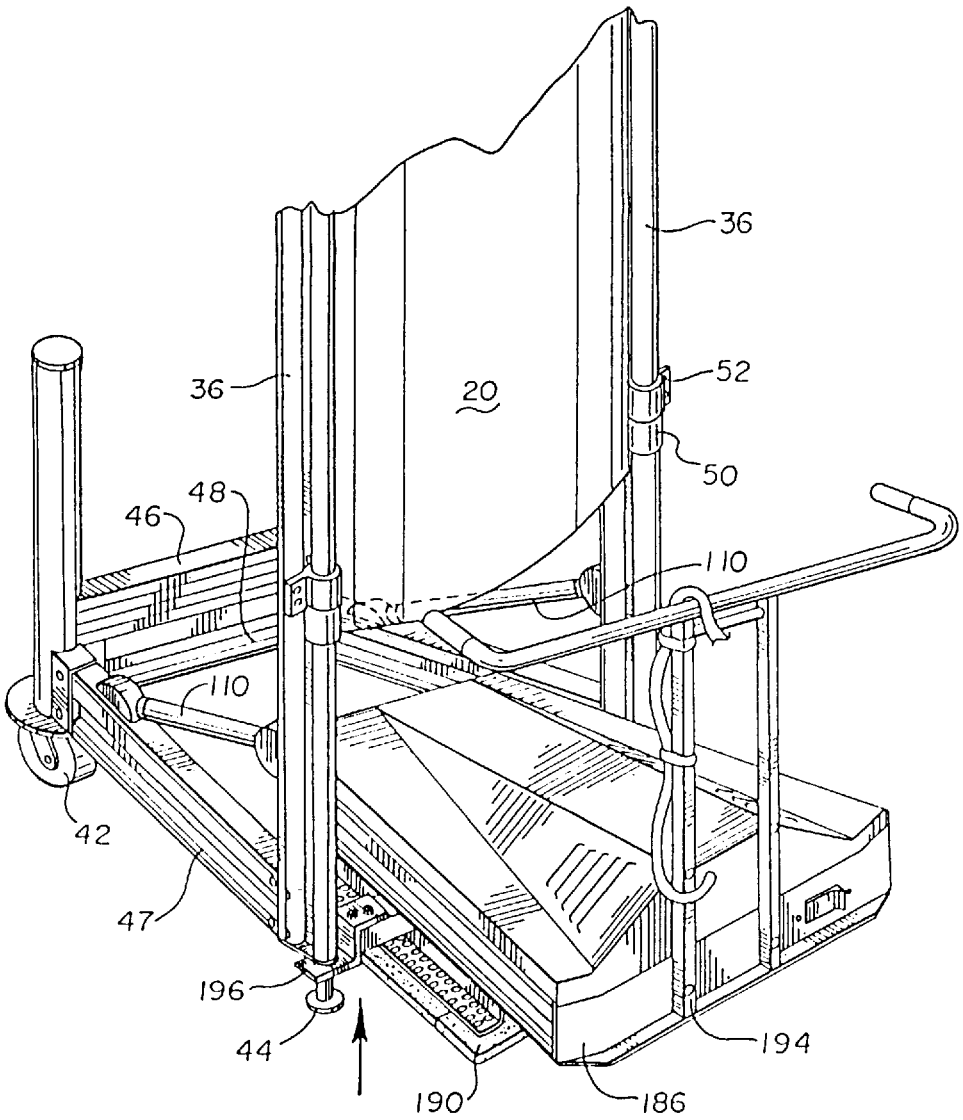
FIG. 15 is a perspective view of the panel transporter engaged with the base of a backdrop panel.

Transport sled 186 is depicted in the backdrop panel 14 engaging position in FIGS. 14 and 15. Transport sled 186 broadly includes a sled frame 188, an air support system 190 and a wheel assembly (not shown). The wheel assembly includes tricycle configured wheels, with the sole wheel at the front thereof and a wheel at each rear corner thereof. The frame of the transport sled 186 includes a front channel (not shown), a right side channel (not shown) extending rearward from the right end of the front channel, a left side channel 192 extending rearward from the left end of the front channel, and a rear vertical assembly 194 cross connecting the rearward ends of the right side channel 42 and left side channel 192.

As depicted in FIG. 15, the filler panel 32 is removed from the backdrop panel 14 by disengaging the filler panel lock 170. The forward end of transport sled 186 is maneuvered into the opening generated thereby. Transport sled 186 is maneuvered until receiving flanges 196 on air support system 190 are in engagement with the legs of feet 44. This is the docked position preparatory to commencing pressurization of the air pressure system. The air pressure system raises the feet 44 off the stage floor 17. In this configuration, the backdrop panel 14 is rollably supported at the front by castors 42 and floatably supported by air pressure generating a cushion of air beneath transport sled 186. The backdrop panel 14 may be repositioned on the stage floor 17 as desired with relatively little force exerted by the stage hands and without causing damage to the surface of the stage floor.

Figure 16:
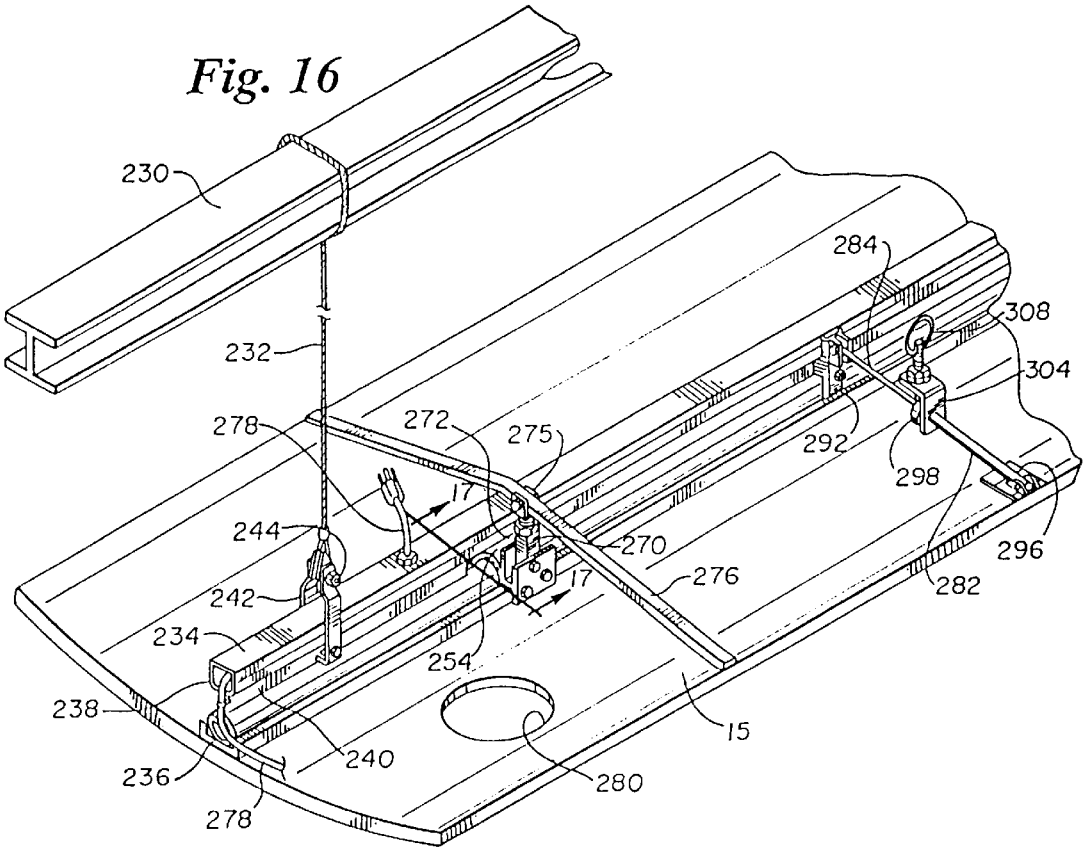
FIG. 16 is a perspective view of the upper side of a canopy suspended from a portion of the building structure.
Figure 17:
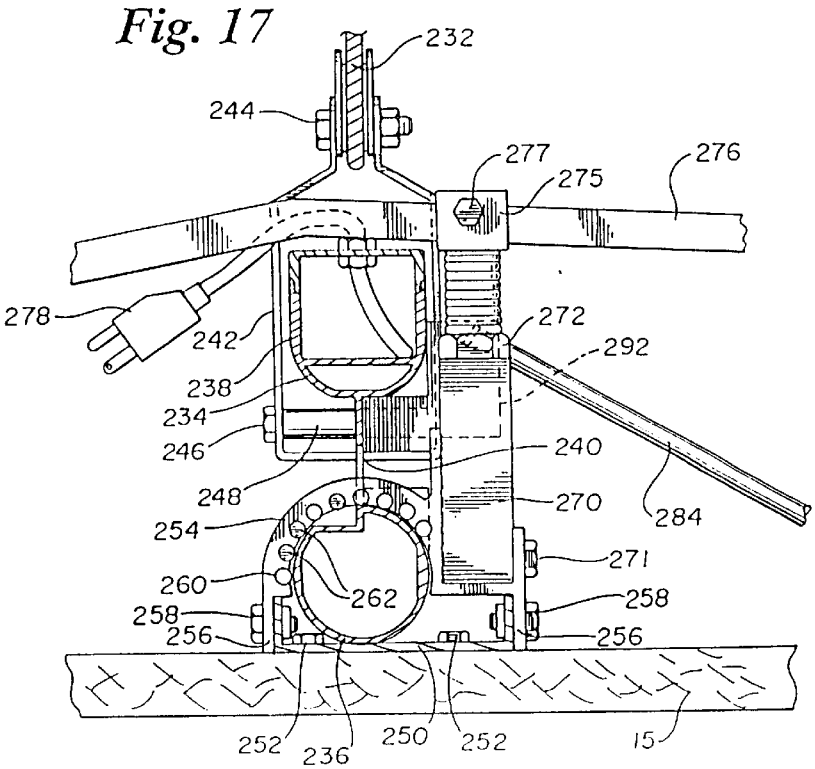
FIG. 17 is a sectional view taken along line 17—17 of FIG. 16.

The details for the suspension of the canopy sections 15 that comprise canopy 12 are depicted in FIGS. 16–19. Referring to FIG. 16, the canopy sections 15 are typically suspended from building structure 30 that is positioned over the stage area. Suspension is by means of a cable 232. The cable 232 may be suspended from a ceiling beam 230 by means of a pulley and counterweight system. Cable 232 is then connected to an electric motor that would permit raising and lowering of the canopy section 15.

The main structural support for canopy section 15 is provided by a centrally mounted support beam 234. Support beam 234 is formed from an identical aluminum extrusion as comprises upright standard 36. Accordingly, support beam 234 has a generally circular section 236 and a generally rectangular section 238 joined by a web 240.

Cable 232 preferably has a loop formed in the end thereof. This loop is affixed to the cable bracket 242 by bolt 244 passing through the eye of the loop. Cable bracket 242 is rotatably affixed to support beam 234 by a bolt passing through a bore formed within the web 240 of support beam 234. A swivel sleeve 248 is placed within cable bracket 242 and the bolt 246 passes therethrough. A channel bracket 250 is mounted by bolts 252 to canopy section 15. Circular section 236 of support beam 234 rests within channel bracket 250. A rotatable hanger bracket substantially encloses circular section 236 of support beam 234. Flanges 256 of hanger bracket 254 are bolted to channel bracket 250 by bolts 258.

Hanger bracket 254 has bearing ways 260 formed therein. Bearing ways 260 are similar in construction to bearing ways 78 formed within hinges 50, 52. Bearings 262 are disposed within bearing ways 260 and provide a sliding engaging surface between the exterior circumference of circular section 236 of support beam 234 and the inner circumference of hanger bracket 254. Accordingly, canopy panel 15 is free to rotate about circular section 236.

A support bar tower 270 is bolted to hanger bracket 254 by bolts 271. A hex nut 272 is mounted atop support bar tower 270. The hex nut 272 is attached to a threaded clevis 275. the threaded clevis 275 is rotatably attached to support bar 276 by clevis pin 277. The ends of support bar 276 are affixed to the side margins of canopy section 15. Rotation of hex nut 272 acts upwardly on support bar 276 to maintain canopy section 15 in a relatively upwardly curved configuration by supporting the edge margins thereof.

The power cable 278 for the light unit is integral to canopy section 15 and is carried within rectangular section 238 of support beam 234. The lighting is installed within lighting receptacle 280.

Figure 19:
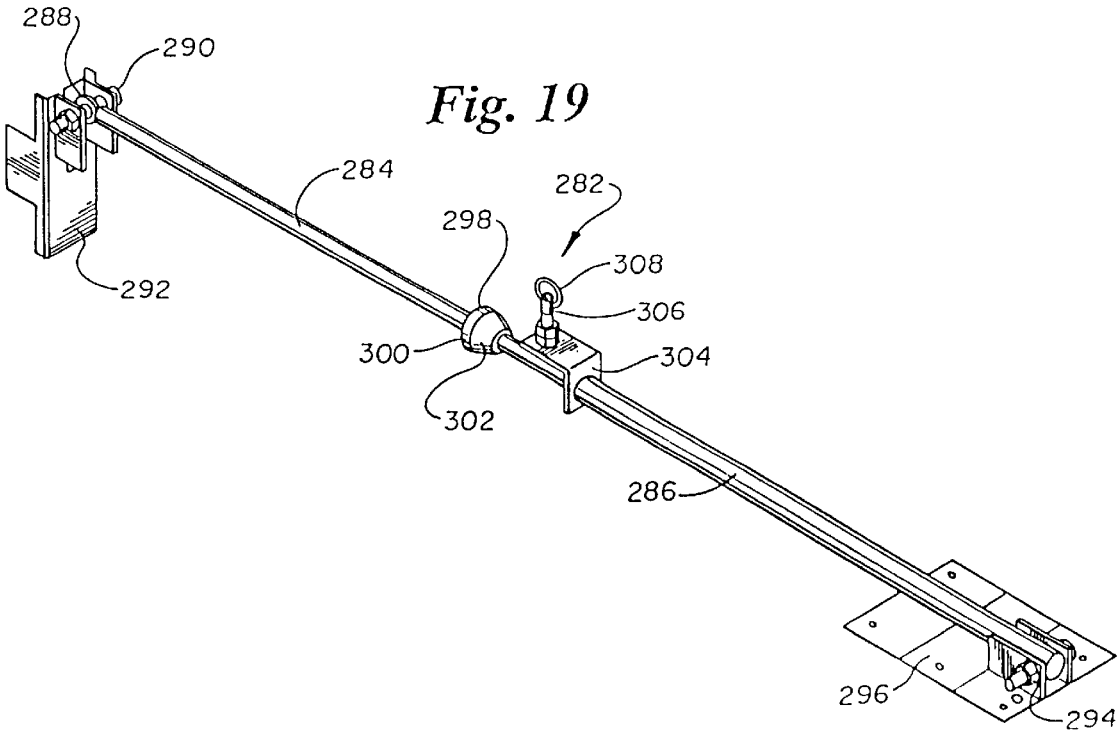
FIG. 19 is a perspective view of the canopy stay assembly.

A canopy stay assembly is provided in order to lock the canopy section 15 at a desired angle. The canopy stay assembly is depicted in FIG. 19. Canopy stay assembly 282 has two major subcomponents: a rod 284 and a sleeve 286. The rod 284 is slideably disposed within sleeve 286. The end of rod 284 has an eye 288, a bolt 290 rotatably affixes the eye to bracket 292. Bracket 292 is mounted to support beam 234.

The end of sleeve 286 has a hole bored therein. A bolt 294 is passed through the bore and affixes the end of sleeve 286 to bracket 296. Bracket 296 is affixed to canopy section 15 approximate the side margin thereof.

A slide stop 298 is slideably mounted on rod 284. Slide stop 298 is set at a desired position utilizing set screw 300. The relative position of slide stop 298 on rod 284 will determine the angle between canopy section 15 and support beam 234. The slide stop 298 has a beveled face 302 that is directed toward L bracket 304.

L bracket 304 is affixed to the end of sleeve 286. A spring loaded pin 306 is mounted to L bracket 304. Due to the lighting being mounted only on one side of support beam 234, the side that has such lighting is heavier than the side of canopy section 15 on which no lighting is installed. Accordingly, left unrestrained, canopy section 15 would tilt such that the portion containing the lighting is in the downward position. Utilizing this bias, when canopy section 15 is rotated to the appropriate angle, the spring loaded pin 306 rides up the face of the beveled face 302 as the rod 284 slides within sleeve 286. As slide stop 298 passes beneath spring loaded pin 306, the spring loaded pin 306 snaps down on the far side of slide stop 298, thereby fixing the angle of canopy section 15.

Figure 18:
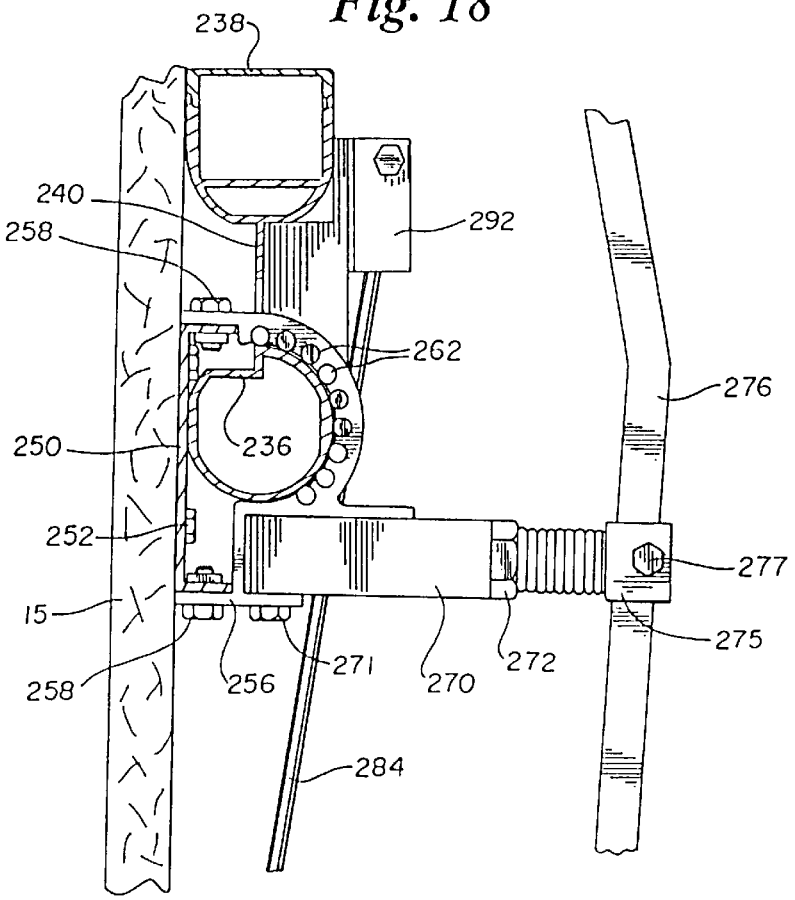
FIG. 18 is a sectional view of a hanger bracket supporting the canopy panel with the canopy panel in the stowed vertical configuration.

To unlock canopy section 15, the spring loaded pin 306 is withdrawn. This is typically accomplished by a lanyard that is passed through ring 308. With spring loaded pin 306 retracted, the weight of the side of canopy section 15 that has the lights installed thereon is free to descend and cause the rotation of canopy section 15 to an upright orientation. This orientation is depicted in FIG. 18. Canopy section 15 may then be raised upward toward building structure 230 for storage in this configuration.

In operation, the transport sled 186 is utilized to move the individual backdrop panels 14 to the desired position on stage floor 17. By utilizing transport sled 186 the very heavy and awkward backdrop panels 14 can be very accurately positioned without undue force being exerted by the stage hands.

Once the backdrop panels 14 are in their desired position, the wing panel sections 22 of each backdrop panel 14 are rotatably positioned with respect to the center panel section 20 to generate the desired shape of stage shell 10. The wing panel sections 22 are easily moved by hand. Additionally, the tilt adjustment arms 110 are rotated by hand to ensure that the tilt of adjacent backdrop panels 14 is the same. When the wing panel sections 22 have been properly deployed and the tilt of the backdrop panels 14 has been adjusted, the handle 156 of the locking positioner 140 is rotated to lock the locking positioner 140 in the desired position. This action ensures that the wing panel sections 22 are locked in their desired angular relationship to the center panel sections 20.

After positioning the backdrop panels 14 as desired, the transport sled 186 is withdrawn and the filler panel 132 is locked in place utilizing filler panel lock 170. The decorative strips 35 may then be snapped in place between the wing panel sections 22 of adjacent backdrop panels 14. This action completes the facade of the stage shell 10 that is presented to the audience at the performance.

At this point, the canopy sections 15 are lowered from the building structure 230 to a position just above the backdrop panels 14. The canopy sections 15 are rotated from their vertical storage position to their generally horizontal performance position. As the canopy panels 15 are rotated into the generally horizontal position, spring loaded pin 306 rides up the beveled face 302 of slide stop 298. Once the spring loaded pin 306 passes beyond slide stop 298, the spring loaded pin again deploys and fixes the angle at which canopy section 15 is suspended.

To store the canopy section 15, spring loaded pin 306 is withdrawn. The force of gravity acts to tilt canopy panel 15 to the vertical position. In this position, canopy panel 15 may be retracted upward to be stored approximate the ceiling structure 230 above the stage floor 17.

I claim:

1. A portable stage enclosure having a backdrop panel assembly, the backdrop panel assembly having at least one generally upright standard supporting at least one fixed upright panel and at least one wing panel by means of a hinge assembly operably carried on a generally cylindrical portion of said upright standard, said hinge assembly presenting an inner, generally tubular sidewall substantially enclosing a portion of the generally cylindrical portion of said upright standard, and including structure defining a plurality of bearing ways and key ways, and a plurality of bearings operably carried by at least some of the bearing ways whereby said wing panel is rotatably supported about said upright standard, and a plurality of keys operably carried by at least some of the key ways whereby said fixed upright panel is generally fixed in angular position along said upright standard, comprising:

the bearing ways being generally cylindrical and intersecting the tubular sidewall to define an opening therebetween, and the key ways being generally rectangular in cross section and intersecting the tubular sidewall to define an opening therebetween.

2. A portable stage enclosure as claimed in claim 1 wherein the bearings are rod shaped, having a cylindrical exterior surface, the bearings being fixedly disposed in the respective bearing ways and presenting an exposed portion thereof in the opening defined between the tubular sidewall and the bearing ways, the exposed portion slidably engaging the generally cylindrical portion of said upright standard.

3. A portable stage enclosure as claimed in claim 1 wherein the keys are elongate having a generally rectangular cross section, the keys being fixedly disposed in the respective key ways and presenting an exposed side thereof in the opening defined between the tubular sidewall and the key ways, the exposed side fixedly, compressively engaging the generally cylindrical portion of said upright standard.

4. A portable stage enclosure as claimed in claim 1 wherein the plurality of bearing ways and key ways presented on the generally tubular sidewall are interspersed in an alternating relationship such that each bearing way is flanked by at least one key way.

5. A portable stage enclosure as claimed in claim 1 wherein the hinge assembly includes a hinge hub, the hinge hub being formed in a generally cylindrical shape from a first and a second mated substantially semi-circular portions, and having an inside surface defining the generally tubular sidewall thereof.

6. A portable stage enclosure as claimed in claim 5 wherein each of the two mated substantially semi-circular portions of the hinge assembly includes a finger, the finger on the first substantially semi-circular portion being designed for cooperative interlocking engagement with the finger on the second substantially semi-circular portion.

7. A portable stage enclosure as claimed in claim 6 wherein each of the two mated substantially semi-circular portions of the hinge assembly further include a mating flange, the two mating flanges being designed to be in registry when the first and a second mated substantially semi-circular portions of the hinge assembly are joined to form the hinge hub.

8. A portable stage enclosure as claimed in claim 5 wherein the hinge assembly includes panel flange means operably fixedly coupled to the hinge hub for fixed engagement with a selected panel of the backdrop panel assembly.

9. A portable stage enclosure having a backdrop panel assembly, the backdrop panel assembly having at least one generally upright standard supporting at least one fixed upright panel and at least one wing panel by means of a hinge assembly operably carried on a generally cylindrical portion of said upright standard, said hinge assembly presenting an inner, generally tubular sidewall substantially enclosing a portion of the generally cylindrical portion of said upright standard, and including structure defining a plurality of bearing ways and key ways, and a plurality of bearings operably carried by at least some of the bearing ways whereby said wing panel is rotatably supported about said upright standard, and a plurality of keys operably carried by at least some of the key ways whereby said fixed upright panel is generally fixed in angular position along said upright standard, the generally upright standard comprising:

a first enclosed structural member having an elongate cavity defined therein;

a hinge receiver having the generally cylindrical portion presented hereon; and a substantially planar web having a first side margin operably fixedly coupled to the first enclosed structural member and having a second opposed side margin operably fixedly coupled to the hinge receiver.

10. A portable stage enclosure as claimed in claim 9 wherein the web has a cutout defining a hinge aperture proximate a portion of the hinge receiver, the hinge aperture for accommodating the hinge assembly when the hinge assembly is disposed enclosing a portion of the generally cylindrical portion thereof.

11. A portable stage enclosure as claimed in claim 9 wherein the first enclosed structural member is formed of two cooperative elongate section members, each of said two cooperative elongate section members having a coupling portion that effects a mating of the two cooperative elongate section members by means of a sliding engagement.

12. A portable stage enclosure as claimed in claim 9 wherein the first enclosed structural member has an electrical power cable disposed therein.

13. A portable stage enclosure as claimed in claim 9, further including a base, supporting the at least one generally upright standard and being disposed generally transverse thereto and an extensible arm having a first end operably coupled to the base and a second end operably coupled to the at least one upright standard whereby selective alteration of the length of the extensible arm alters the angular relationship between the at least one upright standard and the base, comprising:

the extensible arm being operably coupled to the base by a first joint device and being operably coupled to the at least one upright standard by a second joint device, the first and second joint devices being of common design and having a plurality of flanges adapted to fixedly engage the base and the upright standard and having an opposed generally semi-circular mount, the semi-circular mount having joining means for joining to the extensible arm at a desired angle.

14. A portable stage enclosure as claimed in claim 13, wherein the plurality of flanges of the first and second joint devices are disposed on apertures defined in the base and upright standard respectively.

15. A portable stage enclosure as claimed in claim 13, wherein the backdrop panel assembly further includes the extensible arm being operably coupled to the upright standard by a first threaded stud and being operably coupled to a selected side arm of the base by a second threaded stud, the first and second threaded studs having oppositely directed threads whereby rotation of the extensible arm in a selected direction lengthens the extensible arm and rotation of the extensible arm in the opposite direction shortens the extensible arm.

16. A portable stage enclosure as claimed in claim 9, wherein the backdrop panel assembly base has spaced apart first and second side arms and a cross arm connecting the first and second side arms, each of such side arms and cross arm comprising:

a first enclosed structural member having an elongate cavity defined therein;

a second enclosed structural member having an elongate cavity defined therein; and a substantially planar gusset having a first side margin operably fixedly coupled to the first enclosed structural member and having a second opposed side margin operably fixedly coupled to the second enclosed structural member.

17. A portable stage enclosure as claimed in claim 16 further including the elongate cavities defined in the first and second enclosed structural members presenting open end margins and a connector having a first connecting portion received within the open end margins each of the elongate cavities defined within the first and second structural members and a second connecting portion being oppositely directed with respect to the first connecting portion.

18. A suspension system for selectively rotatably and fixedly supporting the panels of a portable stage backdrop panel assembly, comprising:

upright standard means for supporting a plurality of panels in a substantially vertical orientation, a component thereof having a substantially circular exterior margin;

hinge means operably fixedly coupled to a panel for suspending the panel from the upright standard, a component thereof having a substantially circular interior margin and having a plurality of bearing ways and key ways formed therein intersecting the interior margin, the interior margin being disposed substantially encompassing a portion of the exterior margin of the upright standard means;

bearing means for selectively providing a rotational engagement between the upright standard means and the hinge means being disposed within the bearing ways and rotationally engaging the exterior margin of the component of the upright standard means; and key means for selectively providing a fixed engagement between the upright standard means and the hinge means being disposed within the key ways and fixedly engaging the exterior margin of the component of the upright standard means.

19. A suspension system for selectively rotatably and fixedly supporting the panels of a portable stage backdrop panel assembly as claimed in claim 18 wherein the bearings are pressed into the bearing ways in a non-rotational engagement therewith and have a substantially circular exterior margin, a portion of the exterior margin of the bearings being in sliding engagement with the substantially circular exterior margin of the upright standard means.

20. A suspension system for selectively rotatably and fixedly supporting the panels of a portable stage backdrop panel assembly as claimed in claim 18 wherein the keys are pressed into the key ways in a non-rotational engagement therewith and have an exterior margin, a portion of the exterior margin of the bearings being in a substantially fixed engagement with the substantially circular exterior margin of the upright standard means.

21. A portable stage backdrop panel assembly having a plurality of panels, comprising:

a substantially horizontal base having a rear margin and two connecting side margins operably coupling the rear margin;

a pair of spaced apart upright standards supporting the plurality of panels in a substantially vertical orientation and being operably coupled to the base;

a tilt adjustment arm operably coupled at a first end to a side margin of the base and at a second end to an upright standard and being selectively adjustable in length to effect the angular relationship of the upright standard with respect to the base.

22. A portable stage backdrop panel assembly having a plurality of panels as claimed in claim 21 wherein the tilt adjustment arm is operably coupled to the upright standard by a first threaded stud and is operably coupled to the side margin of the base by a second threaded stud, the first and second threaded studs having oppositely directed threads whereby rotation of the tilt adjustment arm in a direction lengthens the tilt adjustment arm and rotation of the tilt adjustment arm in the opposite direction shortens the tilt adjustment arm.

* * * * *

UNITED STATES PATENT AND TRADEMARK OFFICE

CERTIFICATE OF CORRECTION

PATENT NO. : 5,875,591
DATED : March 2, 1999
INVENTOR(S) : Jines

It is certified that error appears in the above-identified patent and that said Letters Patent is hereby corrected as shown below:

Column 1, line 57, after "within" insert --the--.

Column 2, line 50, after "available" insert --,--.

Column 3, line 64, after "the" delete "taken"; after "standard" insert --taken--.

Column 4, line 10, delete "a" and insert --an--.

Column 4, line 44, delete "lower" and insert --lowered.--.

Column 5, line 19, delete "if" and insert --of--.

Column 5, lines 22 and 60, after "310" insert --and--.

Column 7, line 20, after "54" insert --,--.

Column 7, line 54, delete "36, keys" and insert --36. Keys--.

Column 8, line 21, delete "shredded" and insert --threaded--.

UNITED STATES PATENT AND TRADEMARK OFFICE

CERTIFICATE OF CORRECTION

PATENT NO. : 5,875,591

DATED : March 2, 1999

INVENTOR(S) : Jines

It is certified that error appears in the above-identified patent and that said Letters Patent is hereby corrected as shown below:

Column 9, line 28, delete "42" and insert --(not shown)--.

Column 10, line 18, "the" should be capitalized.

Column 11, line 63, after "and", "the key ways . . ." should begin a new indented paragraph.

Column 12, line 35, delete "portions" and insert --portion--.

Column 12, line 61, delete "hereon" and insert --thereon--.

Column 14, line 50, after "base;" insert --and--.

Signed and Sealed this

Thirtieth Day of November, 1999

*Attest:*

*Attesting Officer*

Q. TODD DICKINSON

*Acting Commissioner of Patents and Trademarks*